US009080445B2

(12) United States Patent
Pancaldi et al.

(10) Patent No.: US 9,080,445 B2
(45) Date of Patent: Jul. 14, 2015

(54) ROTARY VOLUMETRIC MACHINE

(75) Inventors: Edoardo Pancaldi, Chiusa San Michele (IT); Raffaella Monti, legal representative, Chiusa San Michele (IT); Andrea Pancaldi, legal representative, Chiusa San Michele (IT); Elisa Pancaldi, legal representative, Chiusa San Michele (IT); Aimone Balbo Di Vinadio, Chiusa San Michele (IT)

(73) Assignee: Captech S.r.l., Turin (IT)

( * ) Notice: Subject to any disclaimer, the term of this patent is extended or adjusted under 35 U.S.C. 154(b) by 0 days.

(21) Appl. No.: 13/984,015

(22) PCT Filed: Nov. 10, 2011

(86) PCT No.: PCT/IB2011/055009

§ 371 (c)(1), (2), (4) Date: Oct. 21, 2013

(87) PCT Pub. No.: WO2012/107810

PCT Pub. Date: Aug. 16, 2012

(65) Prior Publication Data

US 2014/0044580 A1 Feb. 13, 2014

(30) Foreign Application Priority Data

Feb. 10, 2011 (IT) ..... TO2011A0112

(51) Int. Cl.
*F03C 4/00* (2006.01)
*F04C 2/00* (2006.01)
(Continued)

(52) U.S. Cl.
CPC ... *F01C 3/06* (2013.01); *F01C 1/22* (2013.01); *F01C 9/005* (2013.01); *F04C 9/005* (2013.01); *F04C 2240/30* (2013.01); *F04C 2240/603* (2013.01)

(58) Field of Classification Search
USPC ..... 418/16, 51, 68, 196; 123/241, 245, 18 R
See application file for complete search history.

(56) References Cited

U.S. PATENT DOCUMENTS 3,549,286 A 12/1970 Moriarty
6,442,935 B1 * 9/2002 Larsen ..... 418/68

FOREIGN PATENT DOCUMENTS

GB 1103271 A 2/1968
GB 1178399 A 1/1970
GB 2115490 A 9/1983
(Continued)

OTHER PUBLICATIONS

International Search Report and Written Opinion; PCT/IB2011/055009; Mar. 25, 2013.

*Primary Examiner* — Theresa Trieu
(74) *Attorney, Agent, or Firm* — Patterson & Sheridan, L.L.P.

(57) ABSTRACT

A rotary volumetric machine having
a stationary structure;
a rotor, which can turn with respect to the stationary structure about a principal axis of rotation;
a work chamber formed within said rotor;
a disk, which is housed in said work chamber and can turn with respect to the stationary structure about a secondary axis of rotation fixed with respect to said stationary structure, the secondary axis of rotation being inclined with respect to said principal axis of rotation, said disk having a radial through groove;
a diaphragm, which is fixed with respect to said rotor, extends in said work chamber, and engages said radial groove of said disk; and
an inlet opening and an outlet opening for a working fluid, which are formed in said rotor, communicate with said work chamber, and are located on opposite sides of said diaphragm.

9 Claims, 5 Drawing Sheets

(51) Int. Cl.

| | |
|---|---|
| ***F04C 18/00*** | (2006.01) |
| ***F01C 3/06*** | (2006.01) |
| ***F01C 1/22*** | (2006.01) |
| ***F04C 9/00*** | (2006.01) |
| ***F01C 9/00*** | (2006.01) |

(56) References Cited

FOREIGN PATENT DOCUMENTS

| | | | |
|---|---|---|---|
| WO | 0009860 | A1 | 2/2000 |
| WO | 0214800 | A1 | 2/2002 |

* cited by examiner

ROTARY VOLUMETRIC MACHINE

FIELD OF THE INVENTION

The present invention relates to rotary volumetric machines.

In the context of the present invention, the term "volumetric machines" is meant to designate fluid machines that produce the movement of a rotary member exploiting the energy of the fluid or else machines that use the mechanical energy of a rotary member to set in circulation or to compress a flow of fluid.

In particular, the present invention relates to a capsulism constituting a machine for converting fluid energy into mechanical energy or a machine for converting mechanical energy into fluid energy, operating with a working fluid that may be a liquid or a gas.

More specifically, the invention regards a rotary volumetric machine including a work chamber with rotational symmetry and an inclined disk located within the work chamber, in which the relative movement between the inclined disk and the work chamber causes a cyclic variation of volume in the work chamber.

DESCRIPTION OF THE PRIOR ART

The documents Nos. GB1103271, WO02/14800, GB2115490 and GB1178399 describe rotary volumetric machines with an inclined disk that performs a motion of precession. The machines described in these documents comprise a casing having a chamber with rotational symmetry about a principal axis, a diaphragm, which is fixed with respect to the casing and separates from one another an inlet opening and an outlet opening for a flow of fluid, and a disk, which is housed in said chamber and has a median plane that divides the chamber into two sections, in which the disk has a disk axis orthogonal to said median plane and inclined with respect to said principal axis and in which the disk has a radial slit, through which said diaphragm extends.

In operation, the flow of fluid that traverses the work chamber causes an oscillation of the disk such that the axis of the disk performs a motion of precession about said principal axis. The motion of precession is such that the axis of the disk describes a conical surface that is coaxial with principal axis and has its vertex located at the centre of the disk. During said motion of precession, the disk does not turn about its own axis.

Prior art fluid machines with oscillating disk are prevalently used as flowmeters.

It would be desirable to obtain high-power and high-efficiency fluid machines of this type that can be used for example for the production of hydroelectric energy.

The solutions according to the prior art are not suited to obtaining high-power machines. One of the obstacles to the development of rotary volumetric machines of this type for high-power uses is represented by the motion of precession of the inclined disk.

OBJECT AND SUMMARY OF THE INVENTION

The object of the present invention is to provide a rotary volumetric machine of the type defined above that will overcome the problems of the prior art.

The claims form an integral part of the teaching provided herein in relation to the invention.

BRIEF DESCRIPTION OF THE DRAWINGS

The present invention will now be described in detail with reference to the attached drawings, which are provided purely by way of non-limiting example and in which.

DESCRIPTION OF EMBODIMENTS OF THE INVENTION

Figure 1:
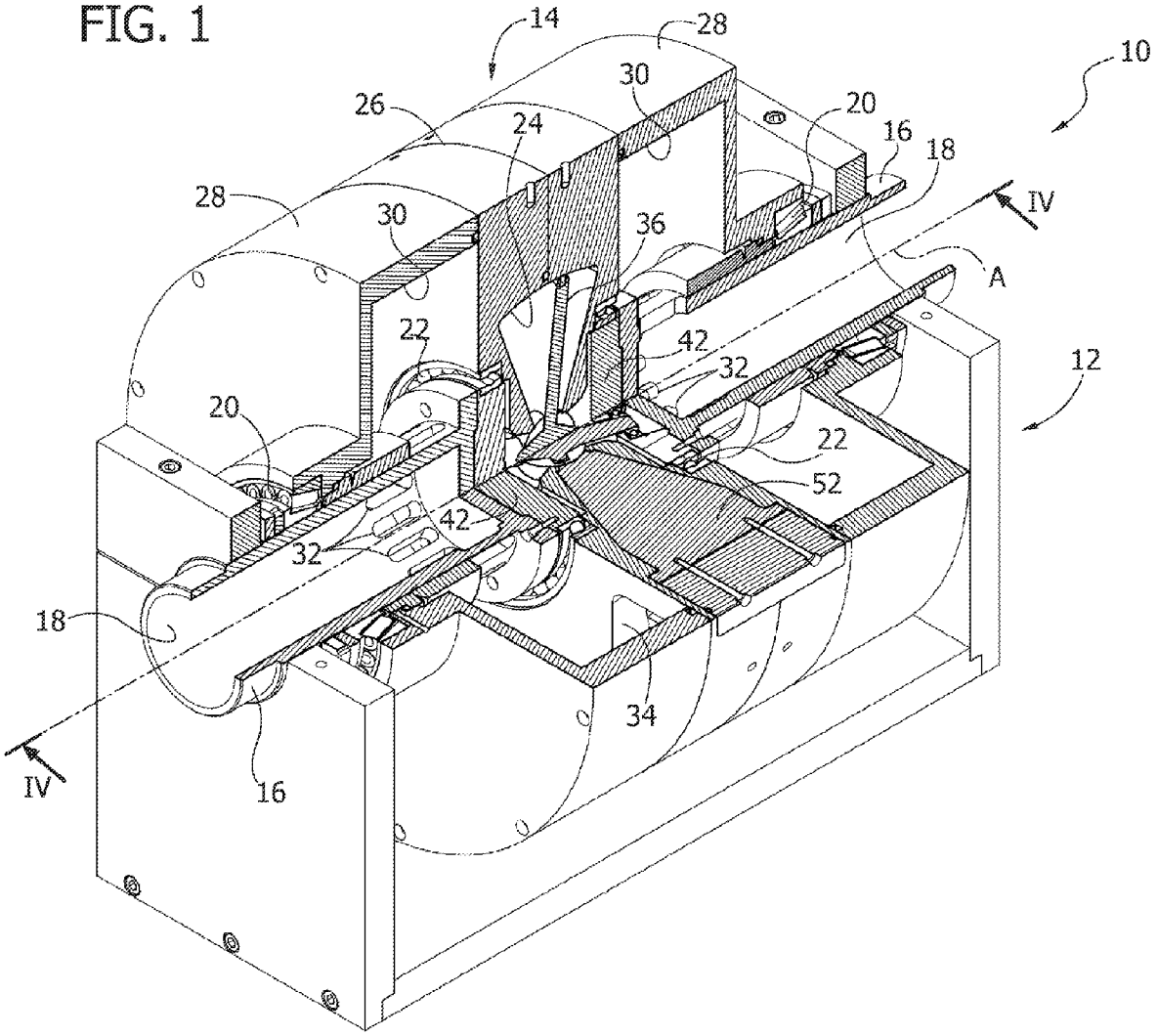
FIGS. 1 and 2 are partially sectioned perspective views of a rotary volumetric machine according to the present invention.
Figure 2:
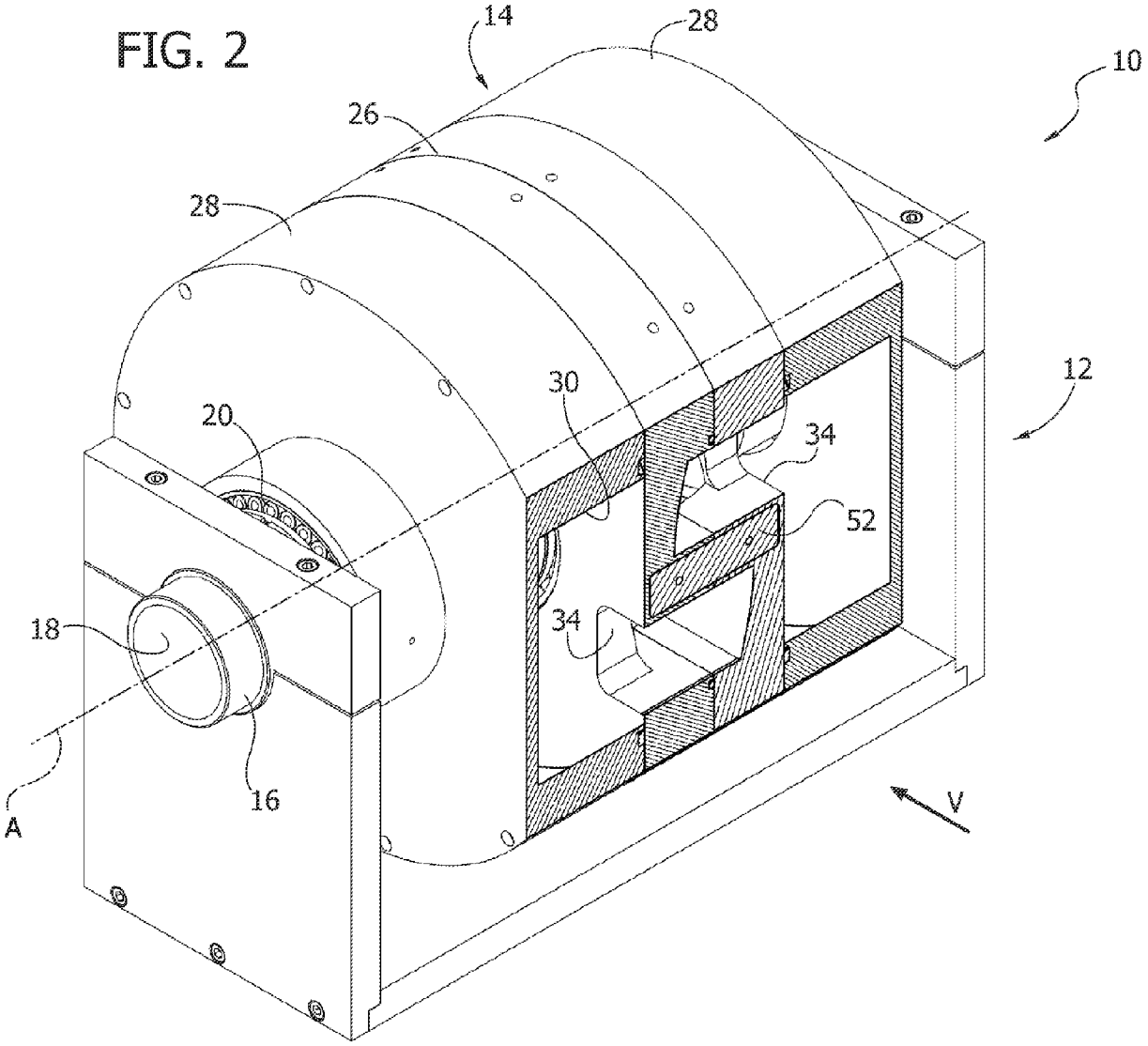

In the ensuing description, various specific details are illustrated aimed at providing an in-depth understanding of the invention. The invention may be implemented without one or more of the specific details, or with other methods, components, materials, etc. In other cases, known structures, materials, or operations are not illustrated or described in detail so that various aspects of the invention will not be obscured.

Reference to "an embodiment" or "one embodiment" in the context of the present description is meant to indicate that a particular configuration, structure or characteristic described in relation to the invention is comprised in at least one embodiment. Hence, phrases such as "in an embodiment" or "in one embodiment" that may be present in various points of the present description do not necessarily refer to one and the same embodiment. Moreover, particular conformations, structures or characteristics can be combined adequately in one or more embodiments.

With reference to the figures, the reference number 10 designates a rotary volumetric machine according to one embodiment of the present invention. The machine 10 comprises a stationary structure 12 and a rotor 14, which can turn with respect to the stationary structure 12 about a principal axis of rotation A.

In one embodiment, the stationary structure 12 comprises two fixed shafts 16 coaxial with the principal axis of rotation A. In one embodiment, the fixed shafts 16 are hollow and define two ducts 18 for inlet and outlet, respectively, of a flow of working fluid. The fixed shafts 16 rotatably support the rotor 14 about the axis A by means of bearings 20 and 22.

The rotor 14 has substantially the shape of a cylindrical body and is rotatably mounted on the outside of the fixed shafts 16. Defined within the rotor 14 is a work chamber 24 set in fluid communication with the ducts 18. In one embodiment, the rotor 14 comprises a central section 26, formed in which is the work chamber 24, and two lateral sections 28, formed in which are two manifold chambers 30. The manifold chambers 30 are in fluid communication with the respective ducts 18, for example by means of openings 32 formed in the side walls of the fixed shafts 18. The manifold chambers 30 are in fluid communication with the work chamber 24 by means of respective openings 34 formed in the central portion 26 of the rotor 14.

Figure 4:
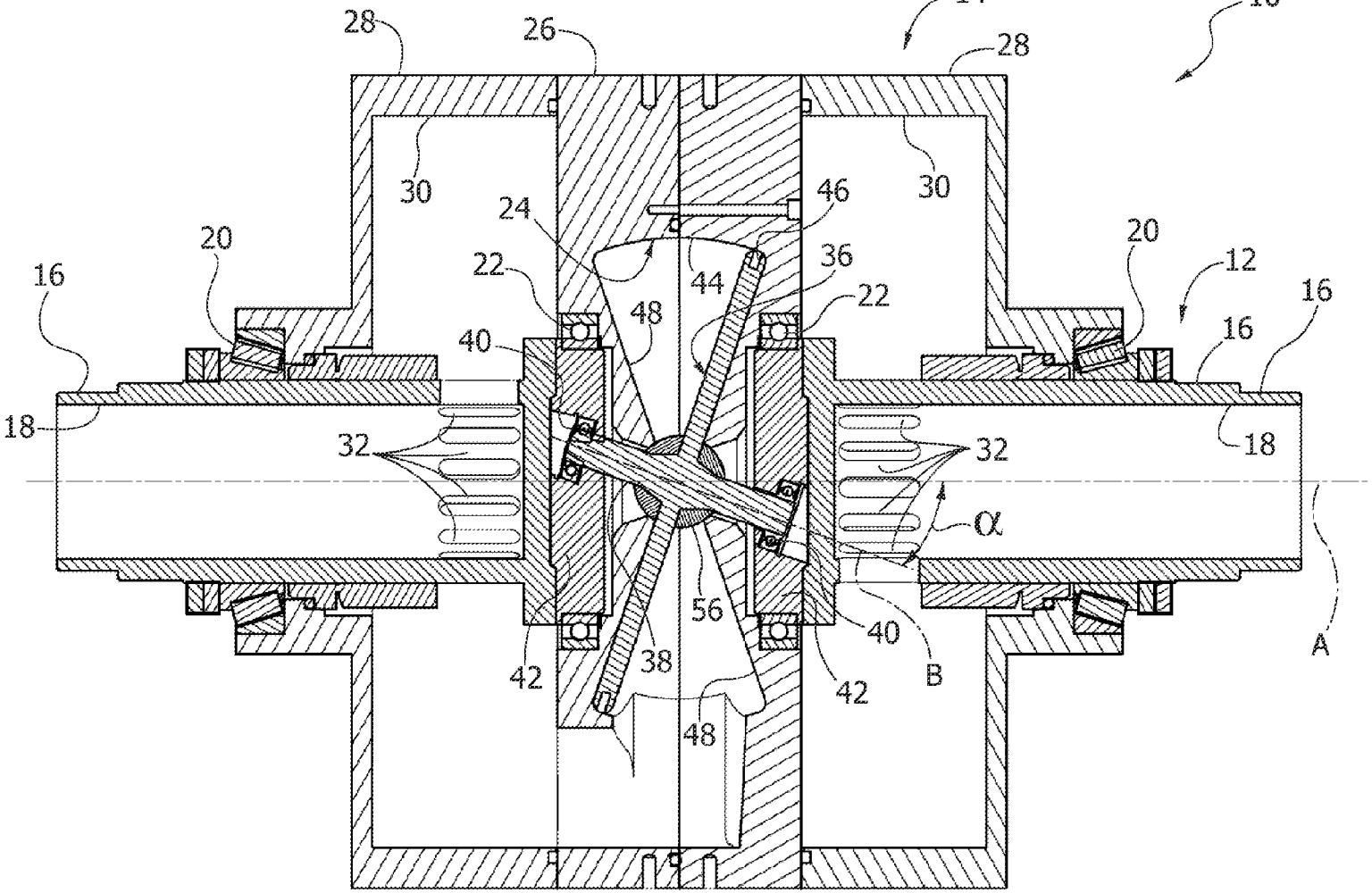
FIG. 4 is a cross section according to the line IV-IV of FIG. 1.
Figure 5:
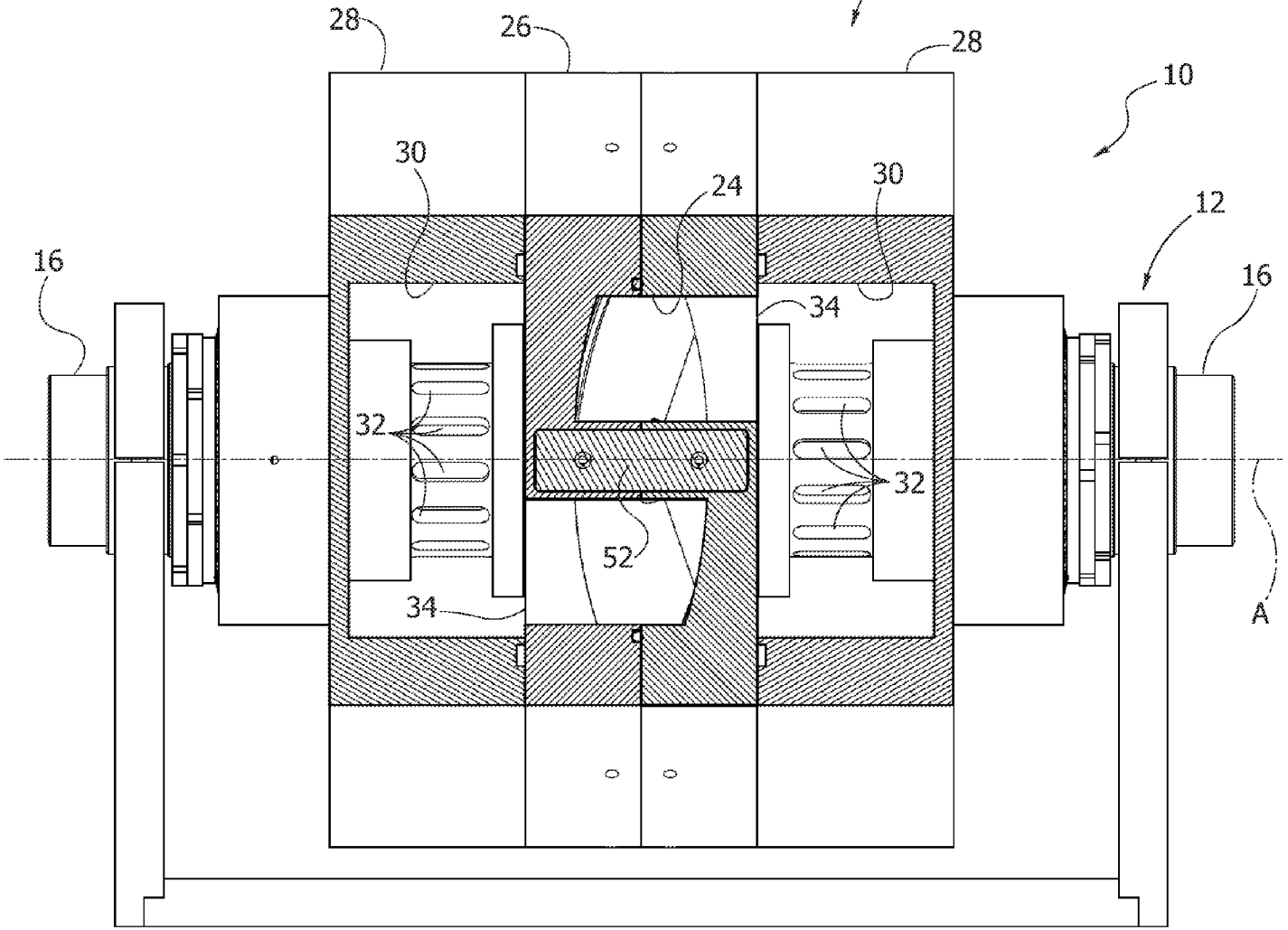
FIG. 5 is a view in elevation according to the arrow V of FIG. 2.

The machine 10 comprises a disk 36, which can turn with respect to the stationary structure 12 about a secondary axis of rotation B inclined with respect to the principal axis of rotation A. An important characteristic of the present invention is that the secondary axis of rotation B of the disk 36 is fixed with respect to the stationary structure 12. With reference, in particular, to FIG. 4, the disk 36 is fixed or integral with a pin 38 coaxial with the secondary axis of rotation B. The pin 38 extends on opposite sides of the disk 36. The ends of the pin 38 are supported in rotation by means of bearings 40 by respective flanges 42 fixed to the corresponding ends of the stationary shafts 16. The disk 36 has just one degree of freedom with respect to the stationary shafts 16, constituted by the rotation about the secondary axis of rotation B. The angle $\alpha$ between the secondary axis of rotation B and the principal axis of rotation A can be comprised between 10° and 35° and is preferably comprised between 18° and 25°.

With reference in particular to FIG. 4, the work chamber 24 has a lateral surface 44 with a spherical shape with centre in the point of intersection between the principal axis of rotation A and the secondary axis of rotation B. The disk 36 has an outer circular rim 46 in sealing contact with the spherical lateral surface 44. In the embodiment illustrated, the work chamber 24 has two front walls 48 with a conical shape that converge on the principal axis of rotation A. The disk has two opposite planar walls orthogonal to the secondary axis of rotation B in linear contact with respective front conical walls 48. Alternatively, the front walls 48 of the work chamber 24 could be planar and orthogonal to the principal axis of rotation A, and the opposite walls of the disk 36 would in this case be conical so as to establish a linear contact with the front walls 48 of the work chamber 24.

Figure 3:
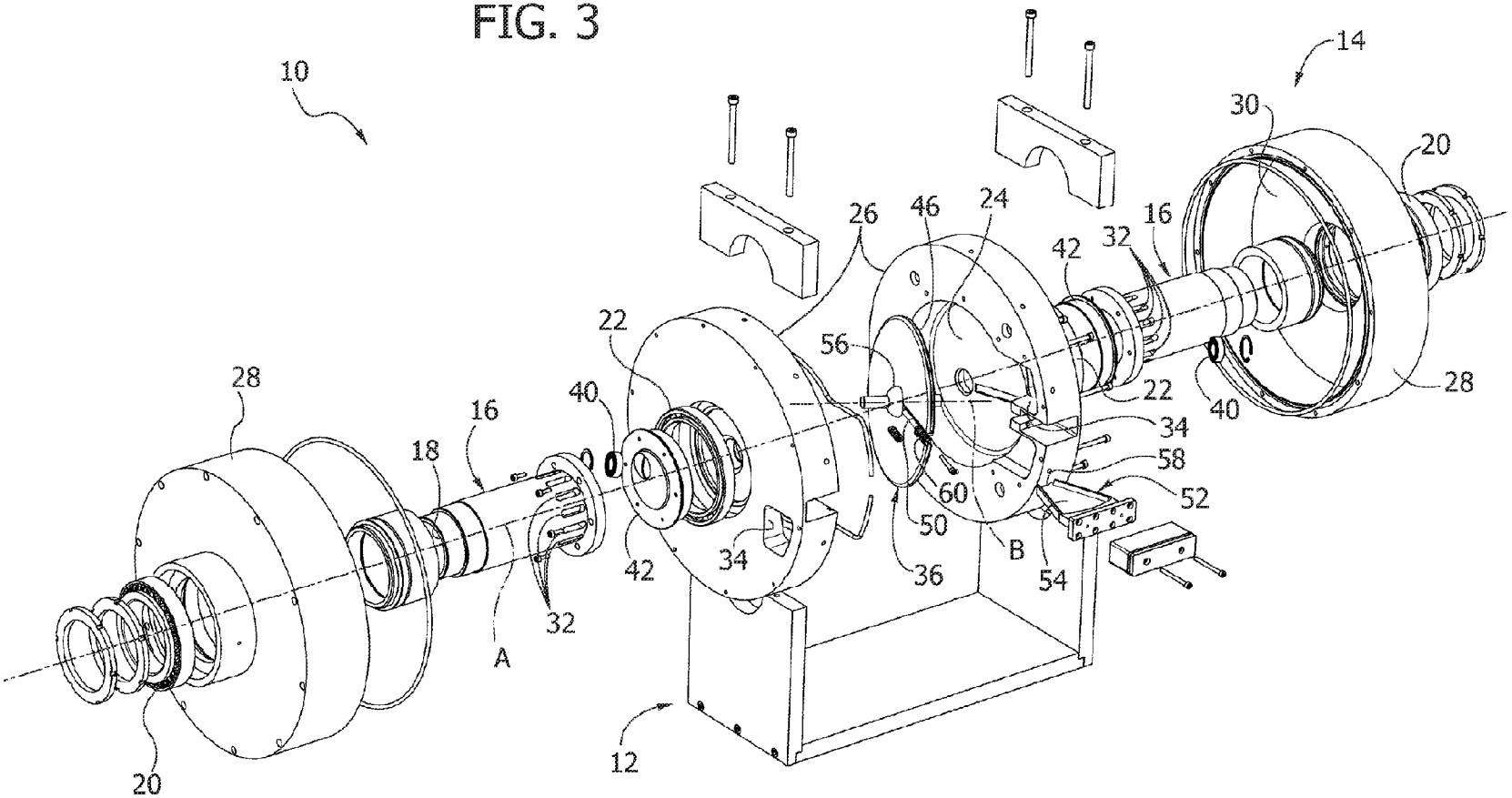
FIG. 3 is an exploded perspective view of the machine of FIGS. 1 and 2.

With reference in particular to FIG. 3, the disk has a through groove 50 directed radially with respect to the secondary axis of rotation B. A diaphragm 52 is inserted in the groove 50 of the disk 36. The diaphragm 52 is fixed with respect to the rotor 14 and has a planar wall 54 that extends in the work chamber 24 and engages the through groove 50.

On one edge of the groove 50 of the disk 36 small rolling bearings 60 may be provided that rest on the wall 54 of the diaphragm 52.

The inlet and outlet openings 34 are set on opposite sides and in the immediate vicinity of the diaphragm 52.

The planar wall 54 of the diaphragm 52 has a shape corresponding to the shape in cross section of one half of the work chamber 24 and is located in a plane passing through the principal axis of rotation A. The disk 36 has a spherical central part 56, and the diaphragm 52 has an internal rim 58 in sealing contact with the spherical central portion 56 of the disk 36. As may be seen in FIG. 4, the spherical central portion 56 of the disk 36 is in sealing contact with the internal edges of the front walls 48 of the work chamber 24. The rotary volumetric machine according to the present invention is a capsulism that can operate with liquids or gases and can operate as machine for converting fluid energy into mechanical energy or else as machine for converting mechanical energy into fluid energy.

In operation as machine for converting fluid energy into mechanical energy, the fluid under pressure enters the machine 10 through one of the ducts 18 and fills the corresponding manifold chamber 30. The pressurized fluid enters the work chamber 24 through the corresponding opening 34. In the work chamber 24, the pressurized fluid acts isotropically on the surfaces 44 and 48 of the work chamber 24, on the opposite surfaces of the disk 36 and on the wall 54 of the diaphragm 52. The pressure of the fluid on the diaphragm 52 produces rotation of the rotor 14 about the principal axis of rotation A. Since the diaphragm 52 is engaged in the groove 50 of the disk 36, the disk 36 is driven in rotation by the rotor 14 and turns about the secondary axis of rotation B. The pressurized fluid exits from the work chamber 24 through the discharge opening 34 located on the opposite side of the diaphragm 52 with respect to the inlet opening and is discharged through the manifold chamber 30 and the outlet duct 18. The rotor 14 can, for example, be connected to an electric generator by means of a gear transmission.

In a possible variant, the working fluid can be carried directly from the inlet duct 18 to the inlet opening 34 and from the outlet opening 34 to the outlet duct 18 without passing through manifold chambers. In this case, rotary manifolds must be provided for supply and discharge of the fluid.

The machine 4 can also operate as pump or compressor. In this case, the rotor 14 is driven in rotation about the principal axis of rotation A. Rotation of the diaphragm 52 within the work chamber 24 produces a negative pressure on the supply duct and a positive pressure on the discharge duct.

The machine 10 can also operate as rotary combustion engine. In this case, the machine is supplied on the supply duct with a mixture of air and fuel. The supply duct must be equipped with a valve, and the work chamber 24 with a spark plug. Ignition of the air-fuel mixture in the work chamber 24 causes expansion of the fluid in the chamber 24, which determines a pressure on the diaphragm 52 and rotation of the rotor 14 about the principal axis of rotation A.

As compared to inclined-disk rotary volumetric machines according to the prior art, the machine according to the present invention eliminates the motion of precession of the disk 36. In the solution according to the present invention, the disk 36 presents a movement of pure rotation about a fixed axis B inclined with respect to the axis of rotation of the rotor 14. This characteristic enables an increase in the efficiency of the machine. The constructional structure of the machine is moreover simplified as compared to prior art machines owing to the fact that it is not necessary to provide the elements that enable the motion of precession of the disk.

Of course, without prejudice to the principle of the invention, the details of construction and the embodiments may vary widely with respect to what has been described and illustrated herein, without thereby departing from the scope of the invention as defined by the ensuing claims.

The invention claimed is:

1. A rotary volumetric machine comprising:
a stationary structure;
a rotor rotatable relative to the stationary structure about a principal axis of rotation;
a work chamber formed within said rotor;
a disk housed in said work chamber and rotatable relative to the stationary structure about a secondary axis of rotation fixed with respect to said stationary structure, the secondary axis of rotation being inclined with respect to said principal axis of rotation, said disk having a radial through groove;
a diaphragm, which is fixed with respect to said rotor, extends in said work chamber, and engages said radial groove of said disk; and
an inlet opening and an outlet opening for a working fluid, which are formed in said rotor, communicate with said work chamber and are located on opposite sides of said diaphragm.

2. The machine according to claim 1, wherein said stationary structure comprises two shafts, coaxial with said principal axis of rotation and on which said rotor is rotatably mounted.

3. The machine according to claim 2, wherein said shafts have respective ducts for inlet and outlet of said working fluid.

4. The machine according to claim 3, wherein said ducts communicate with respective manifold chambers formed in said rotor, said manifold chambers communicating with said work chamber by means of said inlet and outlet openings.

5. The machine according to claim 3, wherein said ducts for inlet and outlet of the working fluid communicate directly with said inlet and outlet openings.

6. The machine according to claim 2, wherein said disk has a pin that is mounted so that it is rotatable about said secondary axis of rotation by means of bearings carried by supports fixed to the ends of said shafts.

7. The machine according to claim 1, wherein said disk has a spherical central portion in sealing contact with one end of said diaphragm.

8. The machine according to claim 1, wherein said disk has an outer circumferential rim in sealing contact with a spherical lateral surface of said work chamber.

9. The machine according to claim 1, wherein said disk is in linear contact with opposite front walls of said work chamber.

* * * * *

UNITED STATES PATENT AND TRADEMARK OFFICE

CERTIFICATE OF CORRECTION

PATENT NO. : 9,080,445 B2
APPLICATION NO. : 13/984015
DATED : July 14, 2015
INVENTOR(S) : Pancaldi et al.

It is certified that error appears in the above-identified patent and that said Letters Patent is hereby corrected as shown below:

On the Title Page, item (75) Inventors:

Please insert --deceased,-- after Edoardo Pancaldi,.

Signed and Sealed this
Second Day of February, 2016

Michelle K. Lee

Michelle K. Lee
*Director of the United States Patent and Trademark Office*